US009500437B2

(12) United States Patent
Grazioplene et al.

(10) Patent No.: US 9,500,437 B2
(45) Date of Patent: Nov. 22, 2016

(54) MUZZLE LOADING SYSTEM

(71) Applicants: Michael J. Grazioplene, Oakfield, NY (US); Jeffrey P. Grazioplene, Batavia, NY (US)

(72) Inventors: Michael J. Grazioplene, Oakfield, NY (US); Jeffrey P. Grazioplene, Batavia, NY (US)

( * ) Notice: Subject to any disclaimer, the term of this patent is extended or adjusted under 35 U.S.C. 154(b) by 0 days.

(21) Appl. No.: 14/941,139

(22) Filed: Nov. 13, 2015

(65) Prior Publication Data

US 2016/0146570 A1 May 26, 2016

Related U.S. Application Data

(60) Provisional application No. 62/085,119, filed on Nov. 26, 2014.

(51) Int. Cl.
*F41C 9/08* (2006.01)

(52) U.S. Cl.
CPC ..... *F41C 9/08* (2013.01)

(58) Field of Classification Search
CPC ..... F41C 9/08; F41C 9/085; F41C 27/00
USPC ..... 42/51; 89/1.3
See application file for complete search history.

(56) References Cited

U.S. PATENT DOCUMENTS 42,741 A * 5/1864 Bradford ..... F41C 9/085 42/90
3,263,664 A * 8/1966 Bauer ..... F41A 9/83 124/49
3,558,007 A * 1/1971 Seghezzi ..... B65D 83/0481 124/45
3,854,625 A * 12/1974 Kuebler ..... B65D 83/0409 221/198
3,956,844 A 5/1976 Misevich et al.
4,050,175 A 9/1977 Mulinix
4,112,606 A * 9/1978 Griffin ..... F41C 9/085 42/90
4,152,858 A 5/1979 Dobbs
4,174,048 A * 11/1979 Volpe, Jr. ..... B65D 83/0409 206/537
4,229,897 A * 10/1980 Snowden ..... F41C 9/085 42/90
4,373,285 A * 2/1983 Grout ..... F41C 9/085 42/90
4,442,620 A 4/1984 Drake et al.
4,466,209 A * 8/1984 Strickland ..... F41C 9/085 42/90
4,817,322 A 4/1989 Dietz et al.
4,862,623 A 9/1989 Delap et al.

(Continued)

OTHER PUBLICATIONS

RMC Magnum EC-Loader, "http://www.rmcoxyoke.com/inc/sdetail/rmc_magnum_ec_loader/6558/201" Nov. 24, 2014.

(Continued)

*Primary Examiner* — Bret Hayes
*Assistant Examiner* — Derrick Morgan
(74) *Attorney, Agent, or Firm* — Michael J. Nickerson; Basch & Nickerson LLP

(57) ABSTRACT

A muzzle loading device includes a hollow shot holding chamber having a first and second end; an actuator located at the first end; and a flexible restraining mechanism and a muzzle alignment feature located at the second end. The flexible restraining mechanism is biased to a closed state, and, in response to the actuator being actuated, goes to an open state. The actuator includes a plunger, a bullet seat, and a spring. The plunger traverses axially along a hollow portion of the hollow shot holding chamber into the muzzle, eliminating the need for a bullet starter. The spring biases the plunger away from the flexible restraining mechanism and limits the traversing distance of the plunger. The hollow shot holding chamber includes an end portion shaped to correspond to an outer geometry of a muzzle.

19 Claims, 6 Drawing Sheets

(56) References Cited

U.S. PATENT DOCUMENTS

| | | | | | |
|---|---|---|---|---|---|
| 4,974,357 | A * | 12/1990 | Jones | F41C 9/085 | 42/90 |
| 5,097,615 | A * | 3/1992 | Kearns | F41C 9/085 | 42/90 |
| 5,109,623 | A | 5/1992 | French | | |
| 5,182,412 | A * | 1/1993 | Mazza | F41C 9/085 | 42/90 |
| 5,435,089 | A * | 7/1995 | Rodney, Jr. | F41C 9/08 | 42/51 |
| 5,446,987 | A | 9/1995 | Lee et al. | | |
| 5,987,799 | A * | 11/1999 | Dedeaux | F41A 15/22 | 42/90 |
| 6,637,143 | B1 * | 10/2003 | Wykle | F41C 9/085 | 224/150 |
| 7,165,351 | B2 | 1/2007 | Church | | |
| 7,204,391 | B2 * | 4/2007 | Toker | A61J 7/0076 | 221/208 |
| 7,451,563 | B1 * | 11/2008 | McKnight | F41C 9/085 | 42/106 |
| 7,877,919 | B2 | 2/2011 | Richards | | |
| 7,954,480 | B2 * | 6/2011 | Broberg, Jr. | F41A 9/01 | 124/45 |
| 8,112,932 | B1 | 2/2012 | Vollmer | | |
| 8,291,894 | B2 * | 10/2012 | Barwick, Jr. | F41B 11/54 | 124/45 |
| 8,308,026 | B2 * | 11/2012 | Rapko | B25B 9/00 | 206/37 |
| 9,021,735 | B2 * | 5/2015 | Ervin | F41A 9/375 | 221/310 |
| 2004/0244260 | A1 * | 12/2004 | Kanyuck | F41C 9/085 | 42/90 |
| 2006/0162218 | A1 * | 7/2006 | Church | F41C 9/085 | 42/51 |
| 2007/0170202 | A1 * | 7/2007 | Chen | A45C 11/00 | 221/267 |
| 2008/0263927 | A1 | 10/2008 | Orlob | | |
| 2011/0302818 | A1 | 12/2011 | Samaras et al. | | |
| 2013/0091752 | A1 * | 4/2013 | Ervin | F41A 9/375 | 42/90 |
| 2014/0090284 | A1 | 4/2014 | Peterson et al. | | |
| 2015/0047245 | A1 * | 2/2015 | Ervin | F41A 9/375 | 42/90 |

OTHER PUBLICATIONS

RMC Magnum EC Speed Shells, "http://www.rmcoxyoke.com/inc/sdetail/magnum_ec_view_speed_shells/6552/202" Nov. 24, 2014.

RMC Flintlock Hunter Starter Kit, "http://www.rmcoxyoke.com/inc/sdetail/rmc_flintlock_hunter_starter_kit/6549/85" Nov. 24, 2014.

* cited by examiner

MUZZLE LOADING SYSTEM

PRIORITY INFORMATION

This application claims priority, under 35 U.S.C. §119(e), from U.S. Provisional Patent Application, Ser. No. 62/085,119, filed on Nov. 26, 2014. The entire content of U.S. Provisional Patent Application, Ser. No. 62/085,119, filed on Nov. 26, 2014, is hereby incorporated by reference.

BACKGROUND

A muzzleloader is a firearm, wherein a projectile (bullet and/or slug) and usually a propellant charge is loaded into the firearm through the muzzle of the firearm.

A conventional muzzleloader loading device utilizes a muzzle loader device having therein formed premeasured powder pellets (propellant charge).

An example of a conventional muzzleloader loading device is described in Published US Patent Application Number 2006/0162218-A1. The entire content of Published US Patent Application Number 2006/0162218-A1 is hereby incorporated by reference.

Published US Patent Application Number 2006/0162218-A1 describes a muzzleloader loading device for a muzzle loading firearm comprised of a hollow tubular body with a ball starter rod stowed, requiring the user to remove the ball starter rod and configure for loading a firearm.

Since the projectile and propellant charge for a muzzleloader is loaded through the muzzle of the firearm, as opposed to being chambered by non-muzzle loading firearms, hunters face the challenge of performing a quick reload to ensure a second shot in a short period of time before the target of the shot disappears or moves out of range, resulting in a missed opportunity, or before the target of the shot converges upon the hunter, resulting in possible injuries.

In other words, time can be of the essence when faced with a first shot mishap and a window of opportunity remains open, as a hunter attempts to reload for a second shot.

Other problems associated with the use of a muzzle loading firearm are wet powder/powder pellets, fouled mechanisms, accidentally loading spent primers, and dropping powder/powder pellets and/or the bullet, etc.

Therefore, it is desirable to provide a muzzle loading device/system that reduces the risk of missed opportunities.

Moreover, it would be desirable to provide a muzzle loading device/system that eliminates or substantially mediates the issues associated with wet powder/powder pellets, fouled mechanisms, and/or accidentally loading spent primers.

It is also desirable to provide a muzzle loading device/system that enables efficient loading of powder/powder pellets and/or bullet, thereby maximizing the speed of loading and minimizing the number of steps.

Further, it would be desirable to provide a muzzle loading device/system that eliminates the risk of a "failed" load (dropping powder/powder pellets and/or the bullet).

Lastly, it would be desirable to provide a muzzle loading device/system that eliminates the risk of a "failed" load (dropping powder/powder pellets and/or the bullet) and also reduces the time to perform the muzzle loading operation.

BRIEF DESCRIPTION OF THE DRAWINGS

The drawings are only for purposes of illustrating various embodiments and are not to be construed as limiting, wherein.

DETAILED DESCRIPTION

Figure 1:
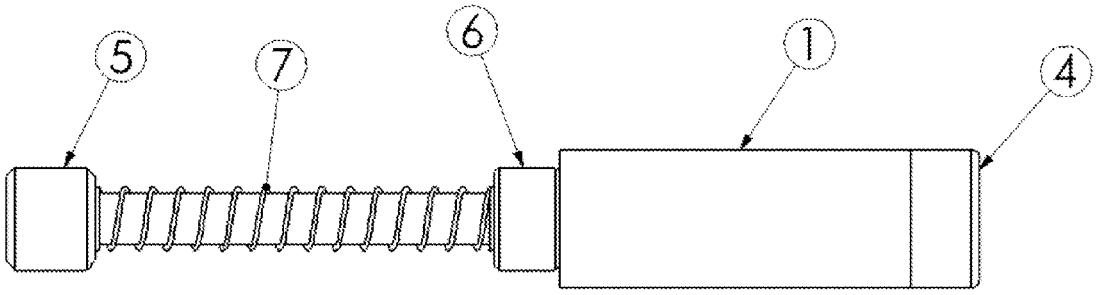
FIG. 1 is an illustration of a muzzle loading device.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

In the description below, the term shot is used to define the object being loaded into a muzzleloader firearm, wherein the object is a combination of propellant and projectile, and the propellant may be various quantities of measured powder or formed premeasured powder pellets.

As noted above, FIG. 1 illustrates a muzzle loading device. As illustrated in FIG. 1, the muzzle loading device includes a shot holding body/chamber 1, which holds the propellant and projectile prior to loading into a muzzle of a firearm, and an actuator or loading mechanism (plunger 5, spring 7, and nut 6) for providing the actuation or force needed to load the shot into an end of a muzzle of a muzzleloader firearm.

The muzzle loading device may include an end cap 4, which slides over the end of the shot holding body/chamber 1, to inhibit moisture, mud, and/or other foreign debris from entering the shot holding body/chamber 1 and impacting the integrity of the powder/powder pellets or propellant.

When the loading mechanism is not assembled to the shot holding body/chamber 1, an additional end cap can be utilized on the opposite end of the shot holding body/chamber 1 to provide weather resistance of a loaded housing chamber for storage, thereby further inhibiting moisture, mud, and/or other foreign debris from entering the shot holding body/chamber 1 and impacting the integrity of the powder/powder pellets or propellant.

Figure 2:
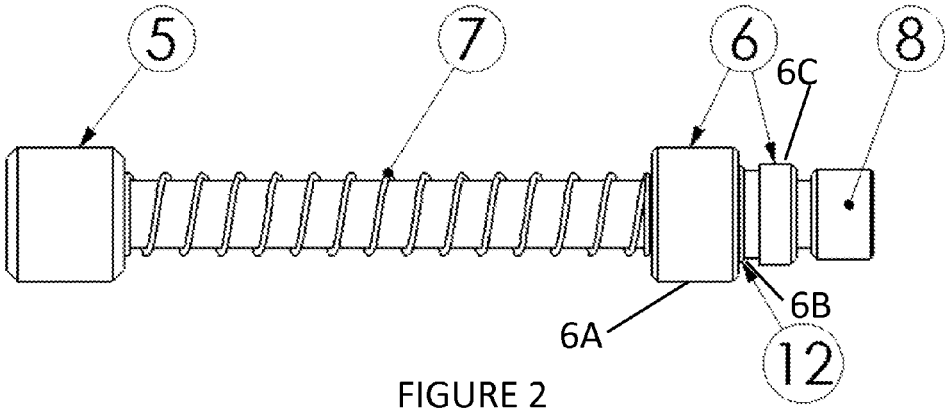
FIG. 2 is an illustration of the loading mechanism (actuator) of the muzzle loading device of FIG. 1.

FIG. 2 illustrates the loading mechanism (actuator) of the muzzle loading device of FIG. 1. As illustrated in FIG. 2, the loading mechanism includes a plunger 5, a spring 7, a nut 6, an O-ring 12, and a bullet seat 8.

The plunger 5 of FIG. 2 is a component that translates along the center axis of the shot holding body/chamber 1 to provide the force needed to move the shot out of the shot holding body/chamber 1 and into the muzzle of the muzzle-loader firearm. The plunger 5 may include a head portion and a rod portion. This component may also include a feature to store a muzzle loader primer (or primer disc) for easy access.

The nut 6 of FIG. 2 is a component that is situated between the bullet seat 8 and the end of the plunger 5. The nut 6 is sized for the plunger 5 to slide freely through the inside diameter of the nut 6. The nut 6 is grooved on an outer diameter to receive an O-ring 12.

The nut 6 may have external threads or alternative non-permanent fastening feature on a reduced diameter region 6C, ahead of the O-ring groove 6B, to enable the nut 6 to screw (or fasten) to the shot holding body/chamber 1, and align the axis of the actuator with the axis of the body/chamber 1, as more specifically described below relative to FIG. 6.

The O-ring 12 seals the shot holding body/chamber 1 to the nut 6 once fully assembled to inhibit moisture, mud, and/or other foreign debris from entering the shot holding body/chamber 1 and impacting the integrity of the powder/powder pellets or propellant.

The outermost surface of shoulder 6A of nut 6 may include a feature (i.e.—knurl, hex, crosshatch) to provide additional grip to ensure nut 6 is screwed or fastened securely to the shot holding body/chamber 1.

It is noted that the nut 6 may be a quick release connection device that enables a secured connection to the shot holding body/chamber 1.

It is further noted that the nut 6 may be a removable connection device that enables a secured connection to the shot holding body/chamber 1.

It is also noted that the nut 6 may provide a permanent connection that enables a secured connection to the shot holding body/chamber 1.

The spring 7 of FIG. 2 encircles the rod portion of the plunger 5 and is situated between the head portion of the plunger 5 and the nut 6.

The spring 7, which may be an optional feature, functions to return the plunger 5 to a starting position after actuation, wherein the rod portion of the plunger 5 is outside the shot holding body/chamber 1 at the starting position.

In other words, the spring 7 functions to bias the plunger 5 away from the shot holding body/chamber 1 connected thereto.

The spring 7 also reduces the risk of an accidental actuation and provides a hard stop to limit the plunger 5 from travelling too far into the shot holding body/chamber 1, thereby preventing the bullet seat 8 from traveling beyond the end of a restraining mechanism (restraining mechanism or flexible finger guide 3 of FIG. 3) in the shot holding body/chamber 1.

The bullet seat 8 of FIG. 2 is located at the end of the rod portion of the plunger 5 to provide an interface between the plunger 5 and a bullet (projectile). The bullet seat 8 pushes on the bullet during actuation and forces the shot out of the shot holding body/chamber 1 and seats the bullet into the muzzle/barrel of the firearm.

Figure 3:
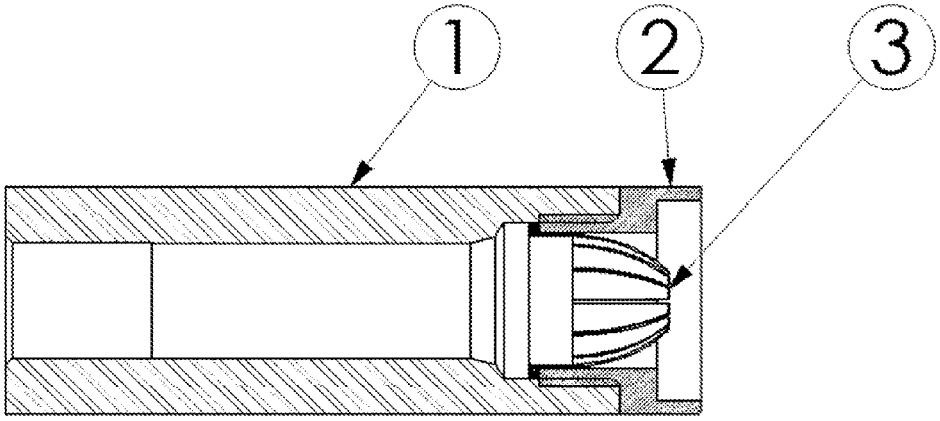
FIG. 3 is an illustration of the "shot" (propellant and projectile) enclosure (holding device) of the muzzle loading device of FIG. 1.

FIG. 3 illustrates the shot holding device of the muzzle loading device of FIG. 1. As illustrated in FIG. 3, the shot holding device includes a shot holding body/chamber 1, a restraining mechanism or flexible finger guide 3, and a barrel seat 2.

The shot holding body/chamber 1 of FIG. 3 is a cylindrical through-hole component that houses the shot (powder/powder pellets and bullet). The shot holding body/chamber 1 is assembled to the restraining mechanism or flexible finger guide 3 by the barrel seat 2.

The shot holding body/chamber 1 also allows clearance for the bullet seat 8 and plunger 5, during actuation.

When the shot holding body/chamber 1 is assembled to the restraining mechanism or flexible finger guide 3 and the barrel seat 2, the powder/powder pellets and bullet are restrained by the restraining mechanism or flexible finger guide 3 which eliminates the risk of dropping or "fumbling" powder/powder pellets and the bullet.

In other words, the restraining mechanism or flexible finger guide 3 substantially eliminates the risk of the powder/powder pellets and/or the bullet from falling out of the shot holding body/chamber 1.

The restraining force of the restraining mechanism or flexible finger guide 3 is approximately the gravitational force on the powder/powder pellets and bullet.

The restraining mechanism or flexible finger guide 3 of FIG. 3 provides axial restraint for the powder/powder pellets and bullet inside the shot holding body/chamber 1. The restraining mechanism or flexible finger guide 3 is a flexible component that is rigid enough to allow for standard handling and even slight shock loads in any orientation without allowing the powder/powder pellets or bullet to fall out of the shot holding body/chamber 1.

The restraining mechanism or flexible finger guide 3 also flexes (open state) to allow for dispersion of the powder/powder pellets and bullet from the shot holding body/chamber 1 to the muzzle/barrel of the firearm when the plunger 5 is actuated so that it travels through the shot holding body/chamber 1.

The restraining mechanism or flexible finger guide 3 may be a replaceable one-time restraint component that restrains the powder/powder pellets and bullet in the body/chamber and is then "spent" once the plunger is actuated and the powder/powder pellets and bullet are dispersed. The restraining mechanism would then need to be replaced in order to restore the muzzle loading device to a state, as described above, with respect to the powder/powder pellets and bullet being restrained by the restraining mechanism or flexible finger guide 3 to eliminate the risk of dropping or "fumbling" powder/powder pellets and the bullet.

Once the powder/powder pellets and bullet are dispersed, and the plunger 5 springs back to the "starting" position, the restraining mechanism or flexible finger guide 3 returns to its original closed state and functionality, which is to restrain powder/powder pellets and bullet inside the shot holding body/chamber 1 prior to actuation.

The restraining mechanism or flexible finger guide 3 allows, when the end cap 4 is off and the muzzle loading device is considered "ready to use", the pellets and the bullet to be still restrained, allowing the user to hold the muzzle loading device in any orientation without the risk of the powder/powder pellets and the bullet falling out of the muzzle loading device.

The barrel seat 2 of FIG. 3 is sized to fit over the end of or over the outer perimeter of a muzzle/barrel of a muzzle-loader firearm. The barrel seat 2 also aligns the muzzle loading device for actuation.

The barrel seat 2 may house restraining mechanism or flexible finger guide 3.

If the barrel seat 2 does not house the restraining mechanism or flexible finger guide 3, the shot holding body/chamber 1 would include a groove or ringed ledge to seat the restraining mechanism or flexible finger guide 3.

The barrel seat 2 may be threaded onto the shot holding body/chamber 1.

It is also noted that the barrel seat 2 may be connected to the shot holding body/chamber 1 using a quick release connection device.

If the barrel seat 2 houses the restraining mechanism or flexible finger guide 3, the connection mechanism used to connect the barrel seat 2 to the shot holding body/chamber 1 could allow loading of the shot holding body/chamber 1 with a shot by removing the barrel seat 2.

The barrel seat 2 may be custom shaped to correspond to various outside diameters or outside geometries of the muzzle/barrel of a firearm to enable the barrel seat 2 to easily slip over the outer perimeter of the muzzle/barrel of the firearm and provide proper alignment for loading.

Figure 4:
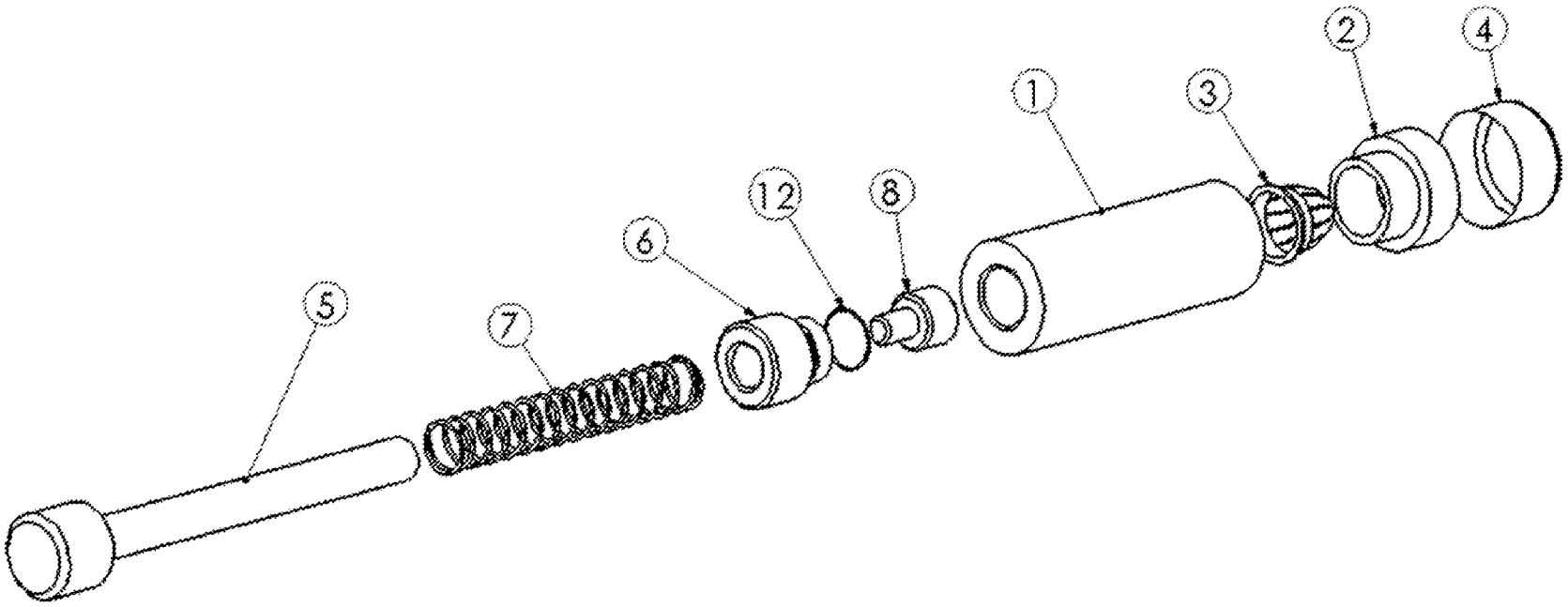
FIG. 4 is an exploded illustration of the muzzle loading device of FIG. 1.

FIG. 4 illustrates an exploded view of the muzzle loading device with an end cap 4. As illustrated in FIG. 4, the muzzle loading device includes a plunger 5, a spring 7, a nut 6, an O-ring 12, a bullet seat 8, a shot holding body/chamber 1, a restraining mechanism or flexible finger guide 3, a barrel seat 2, and an end cap 4.

Figure 5:
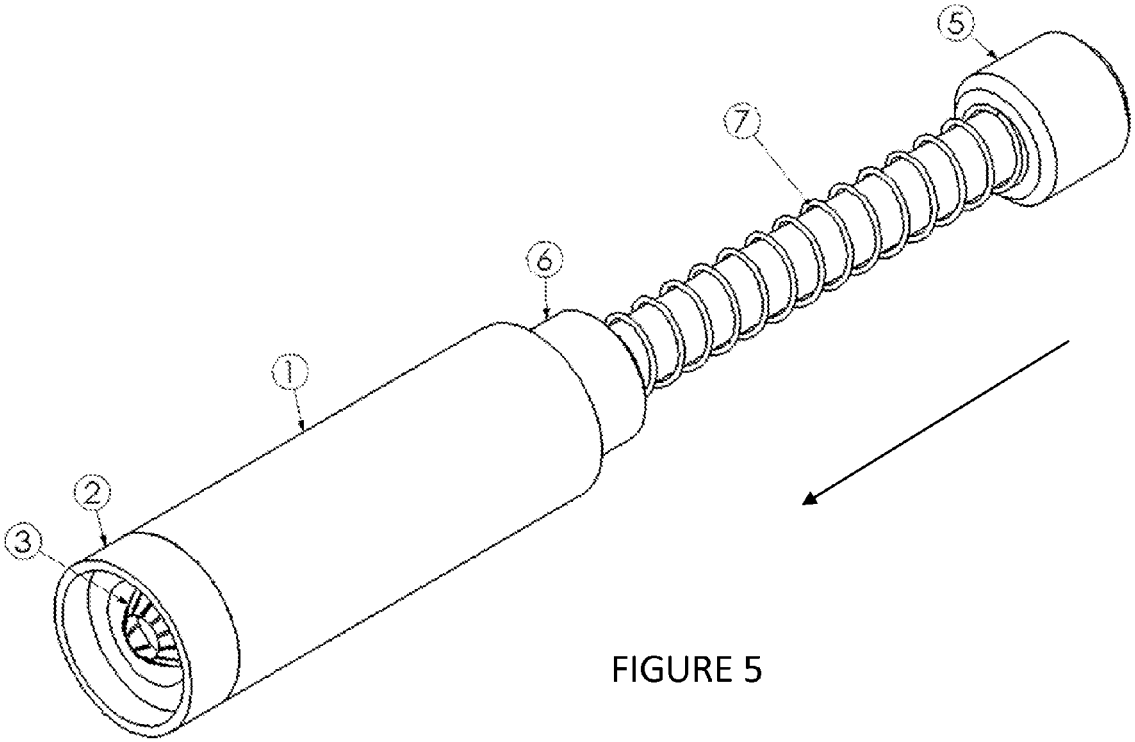
FIG. 5 is an illustration of the muzzle loading device of FIG. 1 in a ready to load state.

FIG. 5 illustrates the muzzle loading device in a "ready to use" state wherein actuation of the plunger 5, in the direction of the arrow, will dislodge the shot from the shot holding body/chamber 1, through the restraining mechanism or flexible finger guide 3, into a muzzle/barrel of a muzzle loading firearm.

Figure 6:
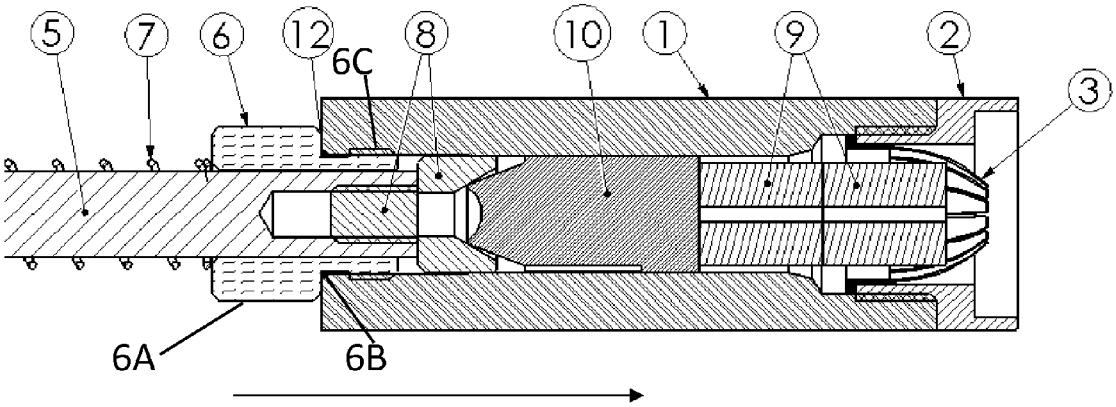
FIG. 6 is a cross-sectional illustration of the muzzle loading device of FIG. 1 in a ready to load state with "shot" (propellant and projectile)

As illustrated in FIG. 6, the shot holding body/chamber 1 holds a bullet 10 and powder/powder pellets (propellant) 9, wherein the positioning of the bullet 10 and powder/powder pellets 9 in the shot holding body/chamber 1 is such that the powder/powder pellets 9 enter the muzzle/barrel of the muzzle loading firearm before the bullet 10 when loading (actuation of the plunger 5 in the direction of the arrow).

Moreover, as illustrated in FIG. 6, restraining mechanism or flexible finger guide 3 holds the bullet 10 and powder/powder pellets 9 in the shot holding body/chamber 1 until the plunger 5 is actuated in the direction of the arrow. The bullet seat 8 provides an interface between the plunger 5 and the bullet 10 and prevents damage to the surface of the bullet 10. FIG. 6 also illustrates the interaction between nut 6 and body/chamber 1.

More specifically, nut 6 may have external threads on the reduced diameter region 6C, to permit the nut 6 to be removably fastened or threaded to the shot holding body/chamber 1.

Although illustrated as mating threads on region 6C and the corresponding interior portion of body/chamber 1, it will be appreciated that another nonpermanent or releasable fastening feature (e.g., ball plunger, bayonet latch biased by the compressed O-ring 12) may be used to accomplish the releasable attachment of the nut 6 to body/chamber 1.

Nut 6 may also include a chamfer or similar feature on a lead edge to enable, along with the releasable attachment feature, the self-alignment of the nut with the body/chamber 1.

Figure 7:
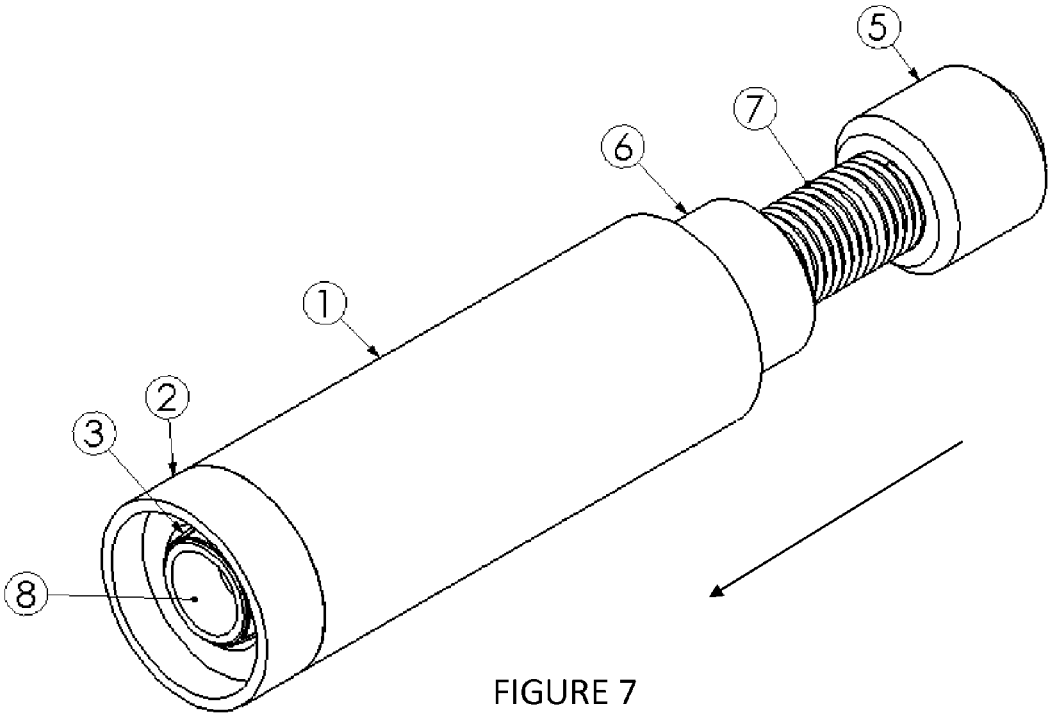
FIG. 7 is an illustration of the muzzle loading device of FIG. 1 in a post actuated state or post loading state.

FIG. 7 illustrates the muzzle loading device after actuation of the plunger 5 in the direction of arrow.

Figure 8:
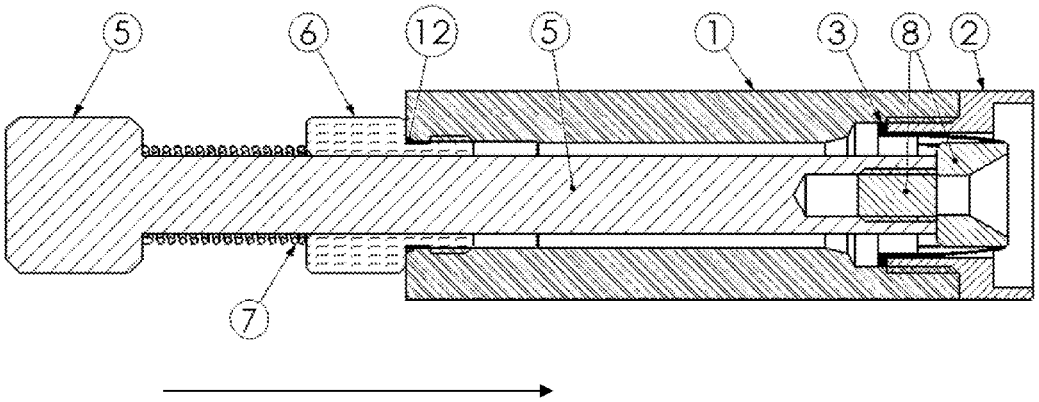
FIG. 8 is a cross-sectional illustration of the muzzle loading device of FIG. 1 in a post actuated state or post loading state.

As illustrated in FIG. 8, the shot holding body/chamber 1 no longer holds a bullet 10 and powder/powder pellets 9 upon actuation of the plunger 5 in the direction of arrow.

FIG. 8 illustrates the restraining function of the spring 7, preventing the bullet seat 8 from going beyond the opened restraining mechanism or flexible finger guide 3.

Figure 9:
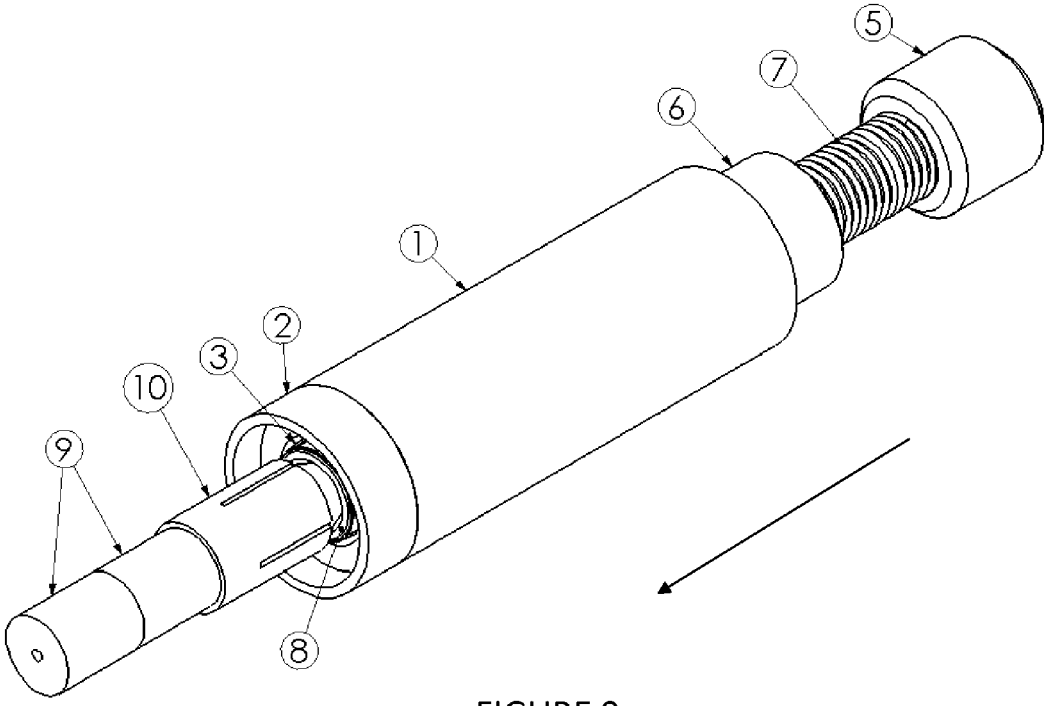
FIG. 9 is an illustration of the muzzle loading device of FIG. 1 with "shot" (propellant and projectile) in a post actuated state or post loading state.

FIG. 9 illustrates the muzzle loading device loading the muzzle/barrel of a muzzle loading firearm, with the bullet 10 and powder/powder pellets 9, after actuation of the plunger 5 in the direction of arrow.

Figure 10:
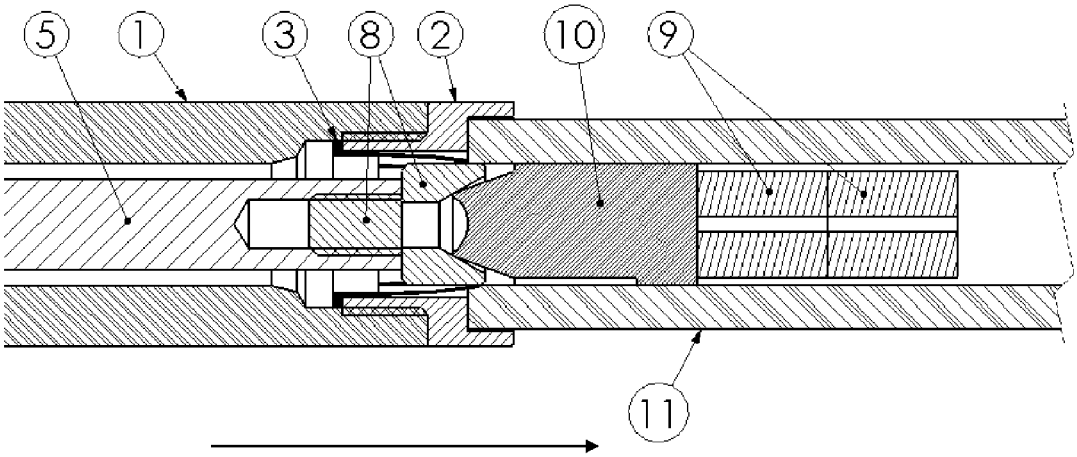
FIG. 10 is a cross-sectional illustration of the muzzle loading device of FIG. 1 with "shot" (propellant and projectile) in a post actuated state or post loading state within the muzzleloader barrel.

As illustrated in FIG. 10, the shot holding body/chamber 1 no longer holds the bullet 10 and powder/powder pellets 9, wherein, upon actuation of the plunger 5 in the direction of arrow, the position of the bullet 10 and powder/powder pellets 9 are in the muzzle/barrel 11 of the muzzle loading firearm.

FIG. 10 illustrates the geometry of the barrel seat 2 corresponds to the outside diameter or outside geometry of the muzzle/barrel 11 of the muzzle loading firearm to enable the barrel seat 2 to easily slip over the outer perimeter of the muzzle/barrel 11 of the muzzle loading firearm and provide proper alignment for loading.

Figure 11:
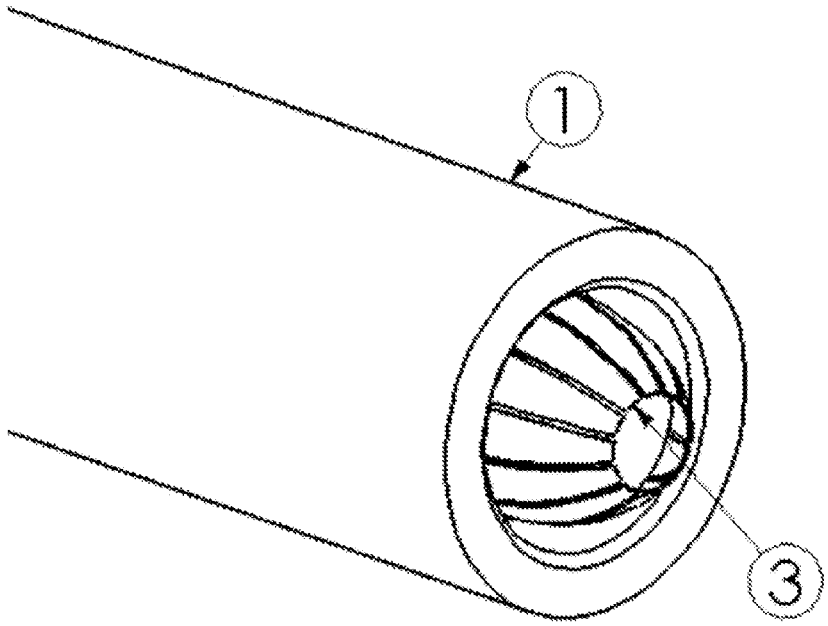
FIG. 11 is an illustration of "shot" (propellant and projectile) restraining mechanism for the muzzle loading device of FIG. 1 in a closed state or ready to load state.

FIG. 11 illustrates the restraining mechanism or flexible finger guide 3 in a closed state or ready to load state.

As illustrated in FIG. 11, the restraining mechanism or flexible finger guide 3 restrains, when the end cap 4 is off, the pellets and the bullet, allowing the user to hold the muzzle loading device in any orientation without the risk of the powder/powder pellets and the bullet falling out of the muzzle loading device.

Figure 12:
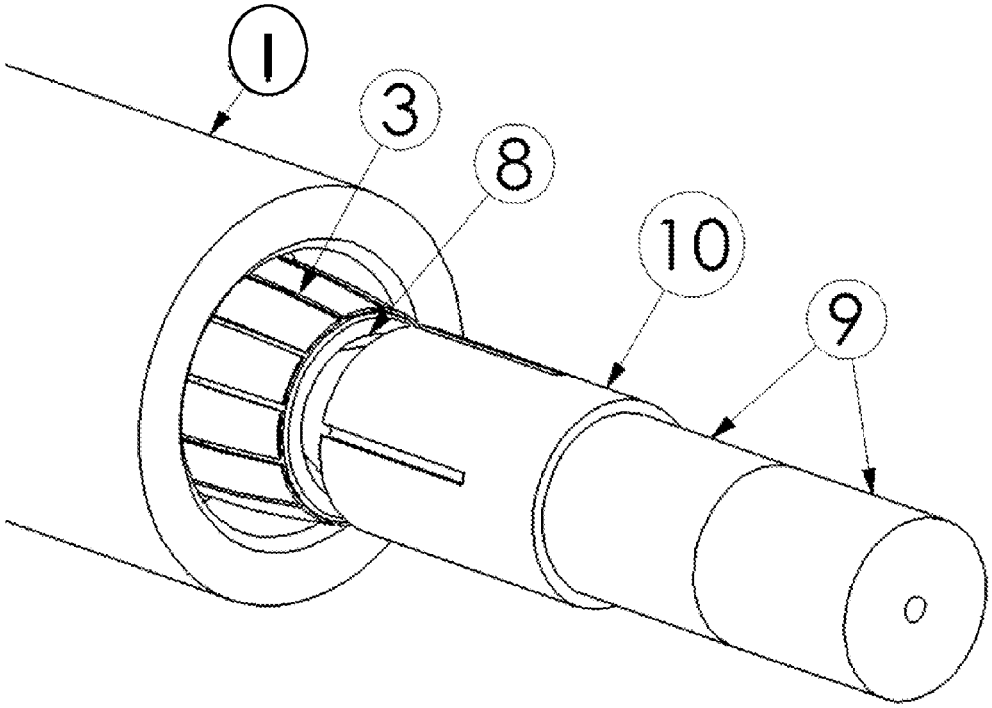
FIG. 12 is an illustration of "shot" (propellant and projectile) restraining mechanism for the muzzle loading device of FIG. 1 in an open state or post actuated state.

FIG. 12 illustrates the restraining mechanism or flexible finger guide 3 in an open state or post actuated state.

As illustrated in FIG. 12, the restraining mechanism or flexible finger guide 3 provides enough flexibility to allow for dispersion of the powder/powder pellets 9 and bullet 10 from the shot holding body/chamber 1 to the muzzle/barrel of the firearm.

The muzzle loading device, as described above, allows a hunter to carry a preloaded powder charge and bullet in a weather resistant chamber assembly.

When ready to load, a hunter does not have to remove caps and dump in powder/powder pellets, then place the bullet over the barrel, ensuring proper alignment, before forcing the bullet into the barrel with a bullet starter.

With the powder/powder pellets and bullet "preloaded" into the muzzle loading device, when a hunter is ready to load the muzzleloader, the end cap is removed and the muzzle loading device is simply placed over the end of the muzzleloader barrel. The hunter then applies a force on the spring loaded actuator, and the powder charge and bullet is dispensed into the muzzleloader barrel in one action.

The hunter does not have to dump the powder/powder pellets in separately, nor utilize a bullet starter to ensure alignment and proper depth prior to using the muzzleloader's ramrod.

To load the muzzle loading device, either the loading mechanism of the muzzle loading device is disassembled from the shot holding device, as illustrated in FIGS. 2 and 3, or the barrel seat 2 is disconnected from the shot holding body/chamber 1. The powder/powder pellets 9 are loaded into the shot holding body/chamber 1, followed by the bullet 10, as illustrated in FIG. 6, or the bullet 10 is loaded into the shot holding body/chamber 1, followed by the powder/powder pellets 9, when the barrel seat 2 is disconnected from the shot holding body/chamber 1.

The shot holding device is now loaded and ready for either installation of end caps 4 on both ends for weather resistant storage, or "Ready to Load" by attaching the nut 6 to the shot holding body/chamber 1.

The hunter's next step, when ready to load, is to place the self-aligning muzzle loading device over the barrel for actuation.

It is noted that when muzzle loading device is in a "ready to use" state, the shot holding body/chamber 1 is sealed by end cap 4 at one end and the O-ring seal 12 on the nut 6 (at the other end) in an attempt to prevent moisture, mud, or other foreign debris from entering the shot holding body/chamber 1 and impacting the integrity of the powder/powder pellets 9.

An alternative "ready to use" state is as described above, without end cap 4, for elimination of the step to remove the end cap prior to load.

It is noted that shot holding body/chamber 1 can be customized based on the number of powder/powder pellets 9, the size of powder/powder pellets 9, and the caliber of the bullet 10. It is also noted that the barrel seat 2 is designed to fit over the outer perimeter of a muzzleloader barrel 11 to allow for proper muzzle loading device actuation and alignment.

As noted above, prior to actuation, the powder/powder pellets 9 and bullet 10 are restrained by the restraining mechanism or flexible finger guide 3 and the bullet seat 8, wherein is the bullet seat 8 constrained by the nut 6.

When the muzzle loading device is properly aligned on the muzzle/barrel 11, the plunger 5 is compressed (by user force) to load the muzzleloader to a "ramrod ready" state.

In summary, a muzzle loading device includes a hollow shot holding chamber having a first end and a second end; an actuator located at the first end of the hollow shot holding chamber; and a flexible restraining mechanism located at the second end of the hollow shot holding chamber; the flexible restraining mechanism being biased to a closed state; the flexible restraining mechanism, in response to the actuator being actuated, going from a closed state to an open state.

The actuator may include a plunger, the plunger traversing a hollow portion of the hollow shot holding chamber.

The actuator may also include a plunger and a spring, the plunger traversing a hollow portion of the hollow shot holding chamber, the spring biasing the plunger away from the flexible restraining mechanism.

The actuator may include a bullet seat.

The actuator may include a plunger, a bullet seat, and a spring, the plunger traversing a hollow portion of the hollow shot holding chamber, the spring biasing the plunger away from the flexible restraining mechanism.

The second end of the hollow shot holding chamber may include an end portion shaped to correspond to an outside geometry of a muzzle.

The end portion may be removable from the hollow shot holding chamber.

The actuator may be removable from the hollow shot holding chamber.

The actuator may be temporarily fastened to and self-aligning to the hollow shot holding chamber.

The actuator may be permanently fastened to and self-aligned to the hollow shot holding chamber.

The flexible restraining mechanism may be replaceable.

The flexible restraining mechanism may be a one-use restraining mechanism.

A muzzle loading device includes a hollow shot holding chamber having a first end and a second end; a first end cap; and a second end cap; the hollow shot holding chamber including a flexible restraining mechanism located at the second end of the hollow shot holding chamber; the flexible restraining mechanism being biased to a closed state; the first end cap providing a seal for the first end of the hollow shot holding chamber; the second end cap providing a seal for the second end of the hollow shot holding chamber.

The first end of the hollow shot holding chamber may include a connection mechanism for connecting an actuator thereto.

The second end of the hollow shot holding chamber may include a connection mechanism for connecting an actuator thereto an end portion shaped to correspond to an outside geometry of a muzzle.

The flexible restraining mechanism may be replaceable.

A muzzle loading device includes a hollow shot holding chamber having a first end and a second end; a first end cap; and a second end cap; the second end of the hollow shot holding chamber including an end portion shaped to correspond to an outside diameter or outside geometry of a muzzle; the end portion including a flexible restraining mechanism; the flexible restraining mechanism being biased to a closed state; the first end cap providing a seal for the first end of the hollow shot holding chamber; the second end cap providing a seal for the second end of the hollow shot holding chamber.

The first end of the hollow shot holding chamber may include a connection mechanism for connecting an actuator thereto.

The end portion may be removable from the second end of the hollow shot holding chamber.

The flexible restraining mechanism may be replaceable.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A device for loading an object into a muzzle comprising:

a shot holding member having a first end to receive an object to be loaded into the muzzle and a second end;

said shot holding member including a hollow shot holding chamber;

an actuator located at said first end of said shot holding member; and a flexible restraining mechanism located at said second end of said shot holding member, said flexible restraining mechanism having an opened state and a closed state;

said flexible restraining mechanism being located within said shot holding member such that said flexible restraining mechanism, when in said opened state, does not extend beyond said second end of said shot holding member;

said flexible restraining mechanism being biased to said closed state;

said flexible restraining mechanism, in response to said actuator being actuated, going from a closed state to an open state;

said actuator including a plunger and a spring;

said spring being located outside said shot holding member when said actuator is connected to said first end of said shot holding member.

2. The device for loading an object into a muzzle, as claimed in claim 1, wherein said plunger traverses a hollow portion of said hollow shot holding chamber and said spring bias said plunger away from said flexible restraining mechanism.

3. The device for loading an object into a muzzle, as claimed in claim 1, wherein said actuator includes a bullet seat.

4. The device for loading an object into a muzzle, as claimed in claim 1, wherein said actuator includes a bullet seat, said plunger traverses a hollow portion of said hollow shot holding chamber, and said spring bias said plunger away from said flexible restraining mechanism.

5. The device for loading an object into a muzzle, as claimed in claim 1, wherein said second end of said shot holding member includes an end portion shaped to correspond to an outside geometry of a muzzle.

6. The device for loading an object into a muzzle, as claimed in claim 5, wherein said end portion is removable from said shot holding member.

7. The device for loading an object into a muzzle, as claimed in claim 5, wherein said actuator is removable from said shot holding member.

8. The device for loading an object into a muzzle, as claimed in claim 1, wherein said actuator is temporarily fastened to and self-aligning to said shot holding member.

9. The device for loading an object into a muzzle, as claimed in claim 1, wherein said actuator is permanently fastened to and self-aligned to said shot holding member.

10. The device for loading an object into a muzzle, as claimed in claim 1, wherein said flexible restraining mechanism is replaceable.

11. The device for loading an object into a muzzle, as claimed in claim 1, wherein said flexible restraining mechanism is a one-use restraining mechanism.

12. A device for loading an object into a muzzle comprising:

a shot holding member having a first end to receive an object to be loaded into the muzzle and a second end;

said shot holding member including a hollow shot holding chamber;

a first end cap; and a second end cap;

said shot holding member including a reusable flexible restraining mechanism located at said second end of said shot holding member, said reusable flexible restraining mechanism having an opened state and a closed state;

said reusable flexible restraining mechanism being located within said shot holding member such that said reusable flexible restraining mechanism, when in said opened state, does not extend beyond said second end of said shot holding member;

said reusable flexible restraining mechanism being biased to said closed state;

said first end cap providing a seal for said first end of said shot holding member to inhibit moisture from entering said hollow shot holding chamber;

said second end cap providing a seal for said second end of said shot holding member to inhibit moisture from entering said hollow shot holding chamber.

13. The device for loading an object into a muzzle, as claimed in claim 12, wherein said first end of said hollow shot holding chamber includes a connection mechanism for connecting an actuator thereto.

14. The device for loading an object into a muzzle, as claimed in claim 12, wherein said first end of said shot holding member includes a connection mechanism for connecting an actuator thereto and said second end being shaped to correspond to an outside geometry of a muzzle.

15. The device for loading an object into a muzzle, as claimed in claim 12, wherein said reusable flexible restraining mechanism is replaceable.

16. A device for loading an object into a muzzle comprising:

a shot holding member having a first end to receive an object to be loaded into the muzzle and a second end;

said shot holding member including a hollow shot holding chamber;

a first end cap; and a second end cap;

said second end of said hollow shot holding chamber including an end portion shaped to correspond to an outside diameter or outside geometry of a muzzle;

said end portion including a reusable flexible restraining mechanism, said reusable flexible restraining mechanism having an opened state and a closed state;

said reusable flexible restraining mechanism being located within said shot holding member such that said reusable flexible restraining mechanism, when in said opened state, does not extend beyond said end portion of said shot holding member;

said reusable flexible restraining mechanism being biased to said closed state;

said first end cap providing a seal for said first end of said shot holding member to inhibit moisture from entering said hollow shot holding chamber;

said second end cap providing a seal for said second end of said shot holding member to inhibit moisture from entering said hollow shot holding chamber.

17. The device for loading an object into a muzzle, as claimed in claim 16, wherein said first end of said shot holding member includes a connection mechanism for connecting an actuator thereto.

18. The device for loading an object into a muzzle, as claimed in claim 16, wherein said end portion is removable from said second end of said shot holding member.

19. The device for loading an object into a muzzle, as claimed in claim 16, wherein said reusable flexible restraining mechanism is replaceable.

* * * * *